United States Patent [19]

Adams

[11] 4,150,633

[45] Apr. 24, 1979

[54] SNAP-ON DARNING AND EMBROIDERY PLATE

[75] Inventor: Kenneth D. Adams, Madison, N.J.

[73] Assignee: The Singer Company, New York, N.Y.

[21] Appl. No.: 882,302

[22] Filed: Feb. 28, 1978

[51] Int. Cl.[2] ..... D05B 73/12

[52] U.S. Cl. ..... 112/260

[58] Field of Search ..... 112/260, 261, 77

[56] References Cited

U.S. PATENT DOCUMENTS

| | | | |
|---|---|---|---|
| 519,260 | 5/1894 | Hunter | 112/260 |
| 1,290,924 | 1/1919 | Davis | 112/260 |
| 2,679,217 | 5/1954 | Kalanick et al. | 112/66 |
| 2,708,892 | 5/1955 | Ayres | 112/260 X |
| 2,877,728 | 3/1959 | Enos | 112/260 |

FOREIGN PATENT DOCUMENTS

| | | | |
|---|---|---|---|
| 607423 | 8/1960 | Italy | 112/260 |
| 28482 of | 1908 | United Kingdom | 112/260 |

*Primary Examiner*—Wm. Carter Reynolds

*Attorney, Agent, or Firm*—William V. Ebs; Robert E. Smith; Edward L. Bell

[57] ABSTRACT

A snap-on darning and embroidery plate, provided for use in conjunction with a needle plate on a sewing machine to render the work feeding mechanism ineffective, is constructed of plastic and structured to provide a spreading action between locating pins thereon when inserted in holes in the needle plate.

1 Claim, 4 Drawing Figures

SNAP-ON DARNING AND EMBROIDERY PLATE

BACKGROUND OF THE INVENTION

1. Field of the Invention

The invention relates to darning and embroidery plates for rendering the work feeding mechanism of a sewing machine ineffective.

2. Description of the Prior Art

It is known to provide darning and embroidery plates for sewing machines enabling an operator to cover feed dog teeth and thereby prevent cloth from being fed under the sewing needle. This permits the operator to manually manipulate the work as required for darning or embroidering. Metal cover plates have been used for the purpose and these were specially fabricated with holding means engageable with mating parts on the sewing machine.

A difficulty encountered in the design of darning and embroidery plates has been that of providing a plate which is both economical to produce and can be reliably secured with ease to the machine. There are at present no satisfactory feed dog cover plates having such characteristics, and it is a prime object of this invention to satisfy the need.

SUMMARY OF THE INVENTION

In accordance with the invention there is provided a darning and embroidery plate of plastic which can be economically and easily produced as a single piece utilizing injection molding techniques, which can be quickly attached to the machine, and which after having been so attached remains reliably secured in position until intentionally removed. Such plastic plate is formed with integral pins for insertion in holes in the needle plate of a machine and with a laterally flexible arm having thereon one of the pins which is aligned with a mating hole in the needle plate by laterally flexing the arm. The resulting spreading action between the locating pins firmly secures the darning and embroidery plate in place on the machine.

DESCRIPTION OF THE PREFERRED EMBODIMENT

Figure 1:
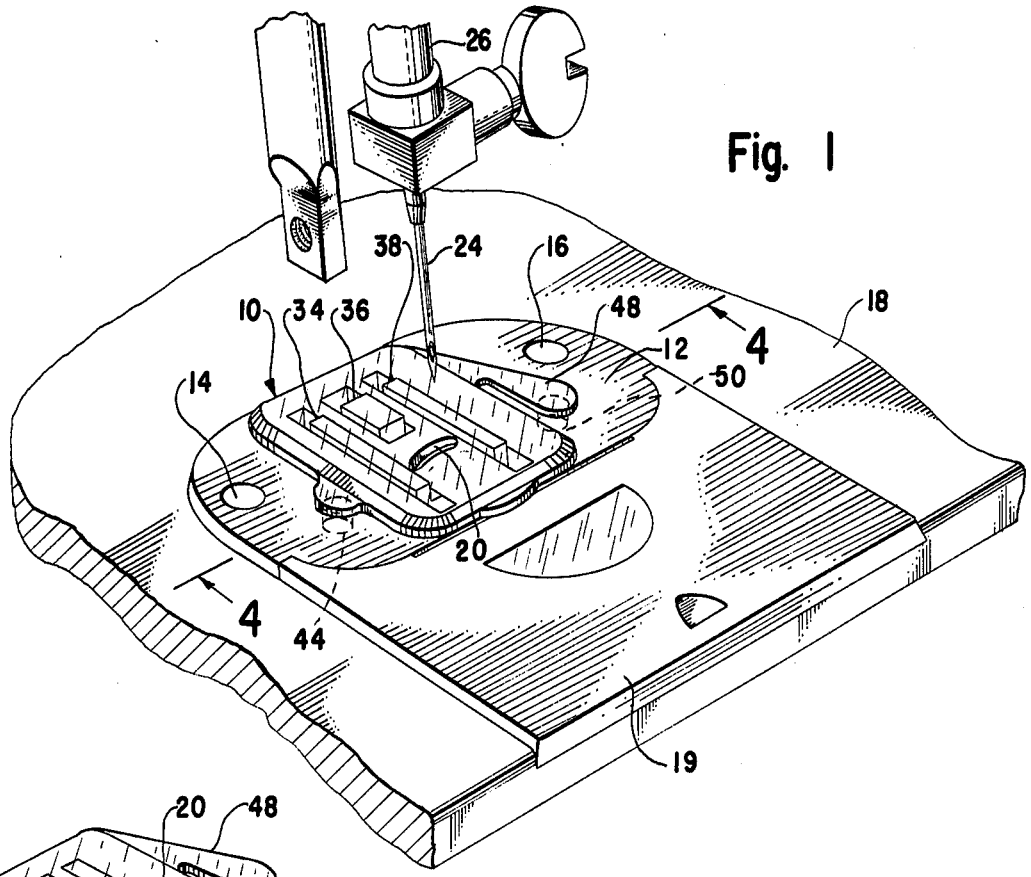
FIG. 1 is a perspective view showing a darning and embroidery cover plate according to the invention in an assembled position on the needle plate of a sewing machine.
Figure 2:
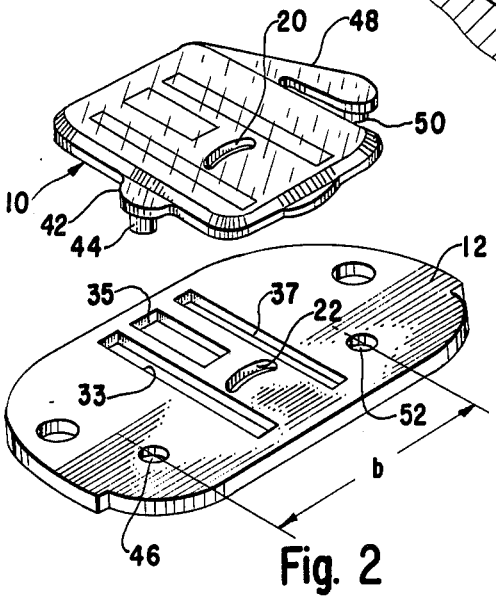
FIG. 2 is an exploded perspective view of the cover plate and needle plate of FIG. 1.
Figure 3:
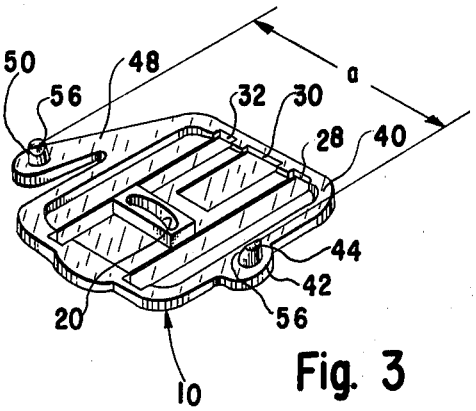
FIG. 3 is a bottom perspective view of the cover plate.
Figure 4:
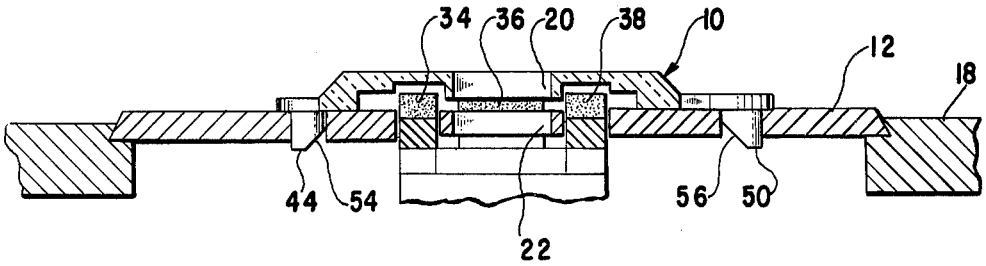
FIG. 4 is an enlarged vertical sectional view taken through the cover and needle plate assembly.

Referring to the drawings, reference character 10 designates a darning and embroidery cover plate according to the invention. Such cover plate 10 attaches to a needle plate 12 which mounts on pins 14 and 16 in the bed 18 of a sewing machine and is contiguous to throat plate 19. The cover plate 10 and needle plate 12 include openings 20 and 22 respectively which are in alignment when the cover plate is secured to the needle plate, and permit the sewing needle 24 to pass through these parts during endwise reciprocation of the needle by needle bar 26. As shown, cover plate opening 20 is arcuate in form, the opening has been configured to match needle plate opening 22 which is capable of accomodating zig zag movements of the needle 24. Although zig zag needle movements are not employed during darning or embroidery operations and needle opening 20 need not be arcuate, it is preferable that it be so in a darning and embroidery plate intended for use on a zig zag machine since needle damage will thereby be prevented if zig zag movements are mistakenly called for by an operator when the cover plate 10 is in place over the needle plate 12 of the machine. The underside of cover plate 10 is formed with elongated recesses 28, 30 and 32 which are provided to accomodate without interference moving feed dog elements 34, 36 and 38 that extend through openings 33, 35 and 37 respectively in needle plate 12.

Marginal edge portion 40 of the cover plate 10 includes a boss 42 which on its underside supports a pin 44 that is inserted in a hole 46 in needle plate 12 when the cover plate 10 attached to it. Marginal edge portion 40 also includes an arm extension 48 which on its underside supports a pin 50 that is inserted in another hole 52 in the needle plate at the time the cover plate 10 is attached to the needle plate 12.

The cover plate 10 including the pins 44 and 50 is an integral unit formed of a plastic material which lends flexibility and resiliency to the arm 48. Any of the polycarbonate plastic materials as well as various other types of plastic materials may be used for the cover plate 10 although a particular one of the polycarbonates sold under trade name "LEXAN" is particularly suitable for use in forming the cover plate because of its durability as well as its resiliency and flexibility. The cover plate 10 is most conveniently made and inexpensively formed using conventional injection molding techniques.

Cover plate 10 is formed with pins 44 and 50 spaced apart by a slightly greater distance a than the distance b between the holes 46 and 52 in the needle plate 12 so that it is necessary to laterally flex the arm 48 to equalize the distance between the pins and their mating holes 46 and 52 when attaching the cover 10 to needle plate 12. This is easily accomplished by gently applying pressure to the end of arm 48 tending to shorten the distance a between the pins.

After the cover plate 10 has been attached to needle plate 12 by inserting pins 44 and 50 in holes 46 and 52 respectively, the natural resiliency of the material of the cover plate which exerts a spreading action on arm 48 is effective to maintain the pins 44 and 50 in tight contact with the sides of their mating holes and the cover plate firmly in place on the needle plate until it is intentionally removed by being pryed upwardly with the finger nail or a small screw driver. As shown, pins 44 and 50 are tapered with oblique inside non-bearing surfaces 54 and 56 respectively which facilitate alignment of the pins with the holes 46 and 52, and insertion therein.

It is to be understood that the present disclosure relates to a preferred embodiment of the invention which is for purposes of illustration only, and that various changes and modifications may be made therein without departing from the spirit and scope of the invention as defined in the appended claims.

Having thus set forth the nature of the invention, what is claimed herein is:

1. A one-piece plastic feed dog cover plate for a sewing machine attachable to a needle plate having a needle aperture and feed dog openings therein, the cover plate and needle plate including mutually engageable parts by means of which the cover plate can be secured to the needle plate in a position overlying the feed dog openings, said cover plate being of a resilient plastic and including as an integral part thereof a single flexible arm, the mutually engageable parts of the needle plate and cover plate including a pin located on the underside of the arm to move with the arm and another pin in a fixed position on the underside of another portion of the cover, said mutually engageable parts also including openings in the needle plate to mate with said pins, and the pins on the cover plate being located to require the flexible arm to be laterially displaced from its unflexed position before the cover plate is secured to the needle plate.

* * * * *